US010747150B2

(12) United States Patent
Uchiyama

(10) Patent No.: US 10,747,150 B2
(45) Date of Patent: Aug. 18, 2020

(54) IMAGE FORMING APPARATUS WITH A CONTROLLER SETTING AN INTERVAL BETWEEN A PRECEDING RECORDING MATERIAL AND A SUBSEQUENT RECORDING MATERIAL

(71) Applicant: CANON KABUSHIKI KAISHA, Tokyo (JP)

(72) Inventor: Koji Uchiyama, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/516,868

(22) Filed: Jul. 19, 2019

(65) Prior Publication Data

US 2020/0026228 A1 Jan. 23, 2020

(30) Foreign Application Priority Data

Jul. 20, 2018 (JP) ..... 2018-136348
Jul. 8, 2019 (JP) ..... 2019-126992

(51) Int. Cl.
*G03G 15/20* (2006.01)

(52) U.S. Cl.
CPC ..... *G03G 15/2039* (2013.01)

(58) Field of Classification Search
CPC ..... G03G 15/2039; G03G 15/2053; G03G 2215/2045
See application file for complete search history.

(56) References Cited

U.S. PATENT DOCUMENTS 9,081,345 B2 7/2015 Uchida et al.
9,261,826 B2 2/2016 Kataoka et al.
9,442,437 B2 9/2016 Honke et al.
2015/0277308 A1* 10/2015 Honke ..... G03G 15/2039 399/69

FOREIGN PATENT DOCUMENTS

JP 2013-076964 A 4/2013
JP 2015-114590 A 6/2015
JP 2015-191154 A 11/2015
JP 2016-021054 A 2/2016

* cited by examiner

*Primary Examiner* — Sophia S Chen
(74) *Attorney, Agent, or Firm* — Venable LLP

(57) ABSTRACT

An image forming apparatus for forming a toner image on a recording material. The image forming apparatus includes an image forming portion configured to form the toner image on the recording material, a fixing portion including a heater and configured to fix the toner image on the recording material by heating the toner image formed on the recording material, and a controller configured to control the image forming apparatus. When toner images are continuously formed on a plurality of recording materials, the controller sets an interval between a preceding recording material and a subsequent recording material depending on unevenness of a print ratio of the subsequent recording material with respect to a direction perpendicular to a recording material feeding direction of the subsequent recording material.

10 Claims, 12 Drawing Sheets

IMAGE FORMING APPARATUS WITH A CONTROLLER SETTING AN INTERVAL BETWEEN A PRECEDING RECORDING MATERIAL AND A SUBSEQUENT RECORDING MATERIAL

CROSS-REFERENCE TO RELATED APPLICATIONS

This application claims the benefit of Japanese Patent Application No. 2018-136348, filed on Jul. 20, 2018, and No. 2019-126992 filed on Jul. 8, 2019, which are hereby incorporated by reference herein in their entirety.

FIELD OF THE INVENTION AND RELATED ART

The present invention relates to an image forming apparatus, capable of forming an image on a recording material, such as a copying machine, a printer, or a facsimile machine. Such image forming apparatus may be an electrophotographic type, for example.

A toner image is transferred onto a recording material at a transfer nip in an image forming portion of the image forming apparatus. The toner image is subsequently heated at a fixing nip downstream of the transfer nip with respect to a recording material feeding direction. The toner image is heated while the recording material is nipped and fed at the fixing nip. In the case where the recording material has taken up moisture, water vapor may be generated when the toner image is heated in the fixing nip. When dew forms on a surface of a rotatable member (pressing roller), a frictional force with a follower rotatable member or the recording material is reduced, so that a phenomenon in which the recording material slips (so-called dew condensation slip) occurs. Such a phenomenon has been known.

The occurrence of the dew condensation slip is influenced by an image to be formed. For example, when a solid image is formed in a broad region of the recording material, toner blocks the water vapor from escaping from that side, and therefore, the generated water vapor escapes toward the pressing roller side. As a result, an amount of the water vapor deposited on the surface of the pressing roller increases, and then, in the case when a print ratio of the image is large, dew condensation slip is more liable to occur.

Therefore, Japanese Laid-Open Patent Application 2016-21054 discloses an acquiring portion that acquires image information that the surface of the pressing roller is warmed before subsequent paper (sheet) reaches the fixing nip. In the case when an areal ratio of an image formed on the subsequent paper during continuous printing, an interval between preceding paper (sheet) and the subsequent paper is increased and thus dew does not readily form on the pressing roller surface, even when the subsequent paper is heated at the fixing nip and water vapor generates in a large amount from the pressing roller side.

However, in the case when images that have a large difference in print ratio (area of the image) are formed at different positions, respectively, with respect to a widthwise direction of the recording material, an amount of water vapor deposited on the pressing roller increases at a large print ratio portion, so that the dew condensation slip is liable to occur. Then, only in a region where the dew condensation slip partly occurs on the pressing roller, the recording material slacks between the transfer nip and the fixing nip (one-side slack).

In the case when one-side slack is conspicuous, a rising portion of the recording material due to the slack contacts a component part on a recording material feeding path, so that an unfixed toner image on the recording material is disturbed and thus an image defect such as image rubbing occurs. Further, in the case when the one-side slack is conspicuous and the slack of the recording material cannot be absorbed, the recording material enters the fixing nip in a state in which the recording material is folded, so that recording material creases occur in some instances.

SUMMARY OF THE INVENTION

A principal object of the present invention is to provide an image forming apparatus capable of suppressing occurrences of image rubbing and recording material creases by reducing a degree of unevenness of a recording material feeding force in a fixing nip even in the case when unevenness of a print ratio with respect to a widthwise direction in large.

According to one aspect, the present invention provides an image forming apparatus for forming a toner image on a recording material. The image forming apparatus includes an image forming portion, a fixing portion, and a controller. The image forming portion is configured to form the toner image on the recording material. The fixing portion includes a heater and is configured to fix the toner image on the recording material by heating the toner image formed on the recording material. The controller is configured to control the image forming apparatus. When toner images are continuously formed on a plurality of recording materials, the controller sets an interval between a preceding recording material and a subsequent recording material depending on unevenness of a print ratio of the subsequent recording material with respect to a direction perpendicular to a recording material feeding direction of the subsequent recording material.

Further features of the present invention will become apparent from the following description of exemplary embodiments with reference to the attached drawings.

Figure 9:
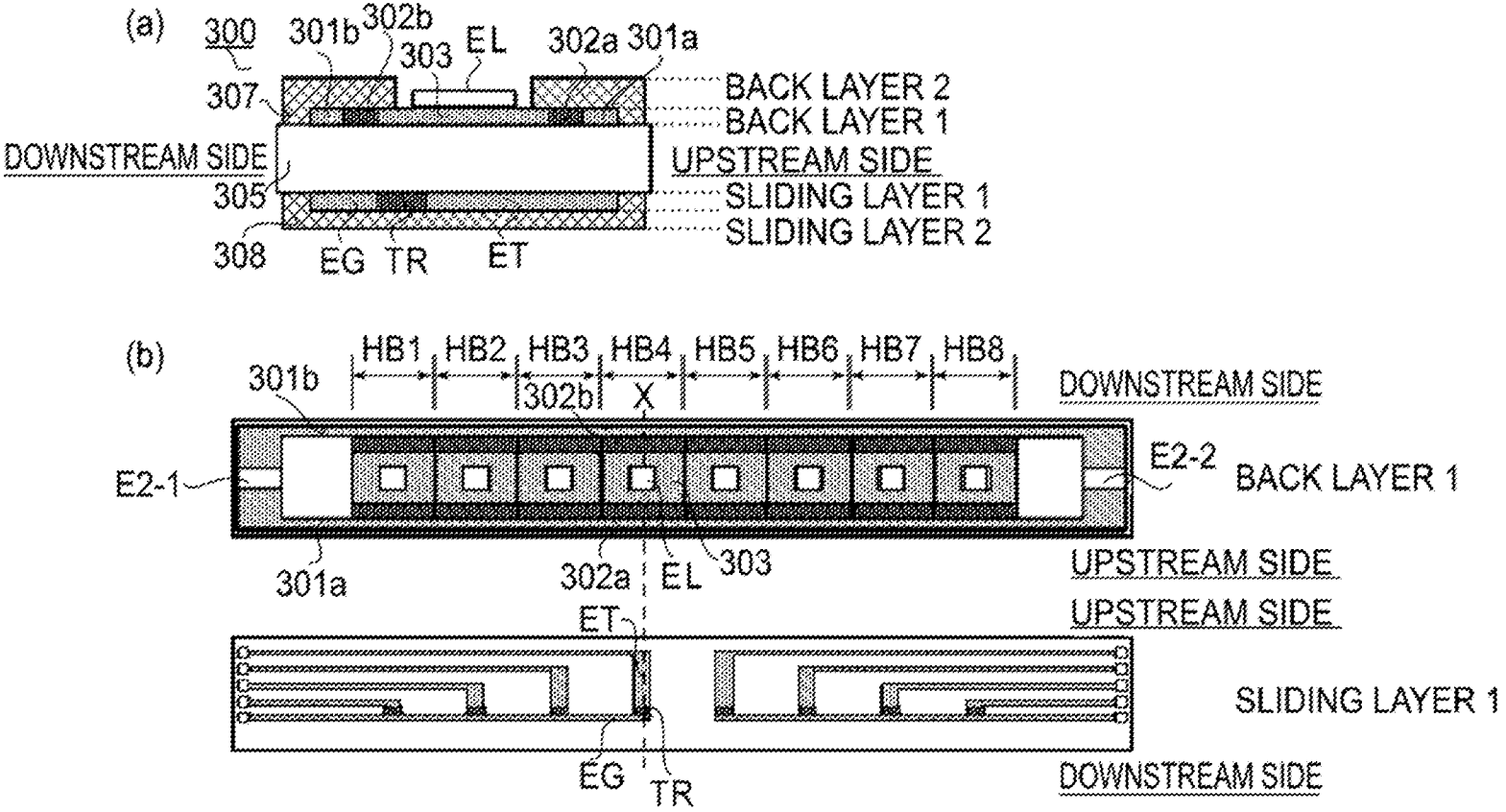

Parts (a) and (b) of FIG. 9 are schematic views of the division heater 300 in the Third Embodiment.

Figure 10:
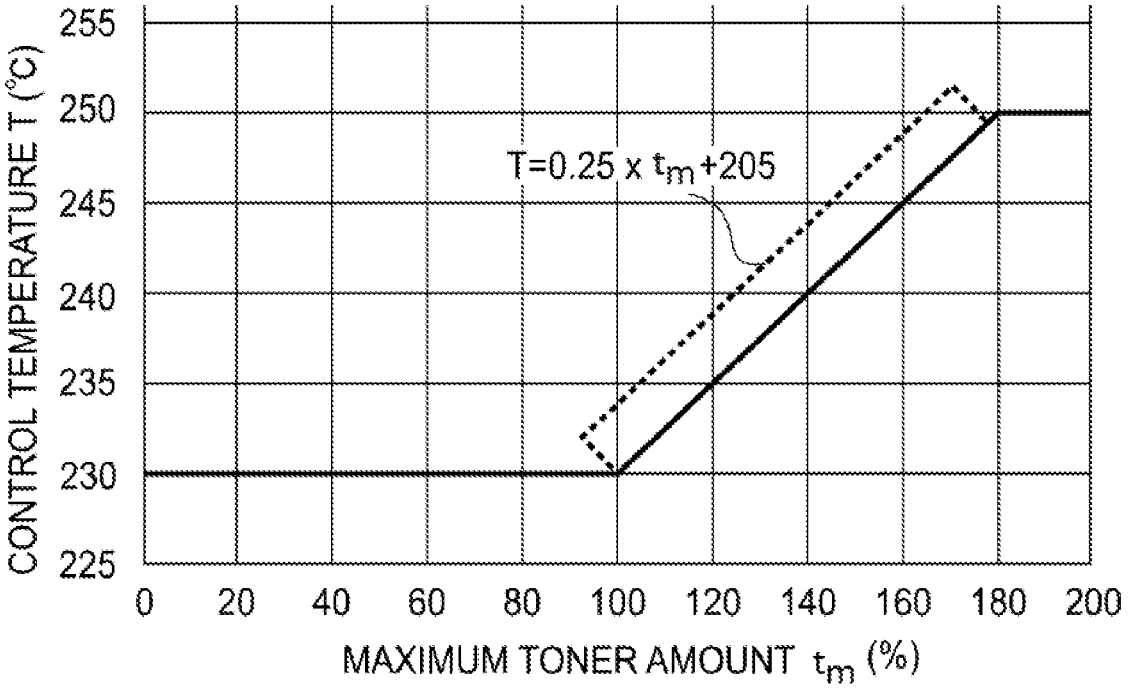

FIG. 10 is a graph showing a relationship between a maximum toner amount and a heater control temperature.

Figure 11:
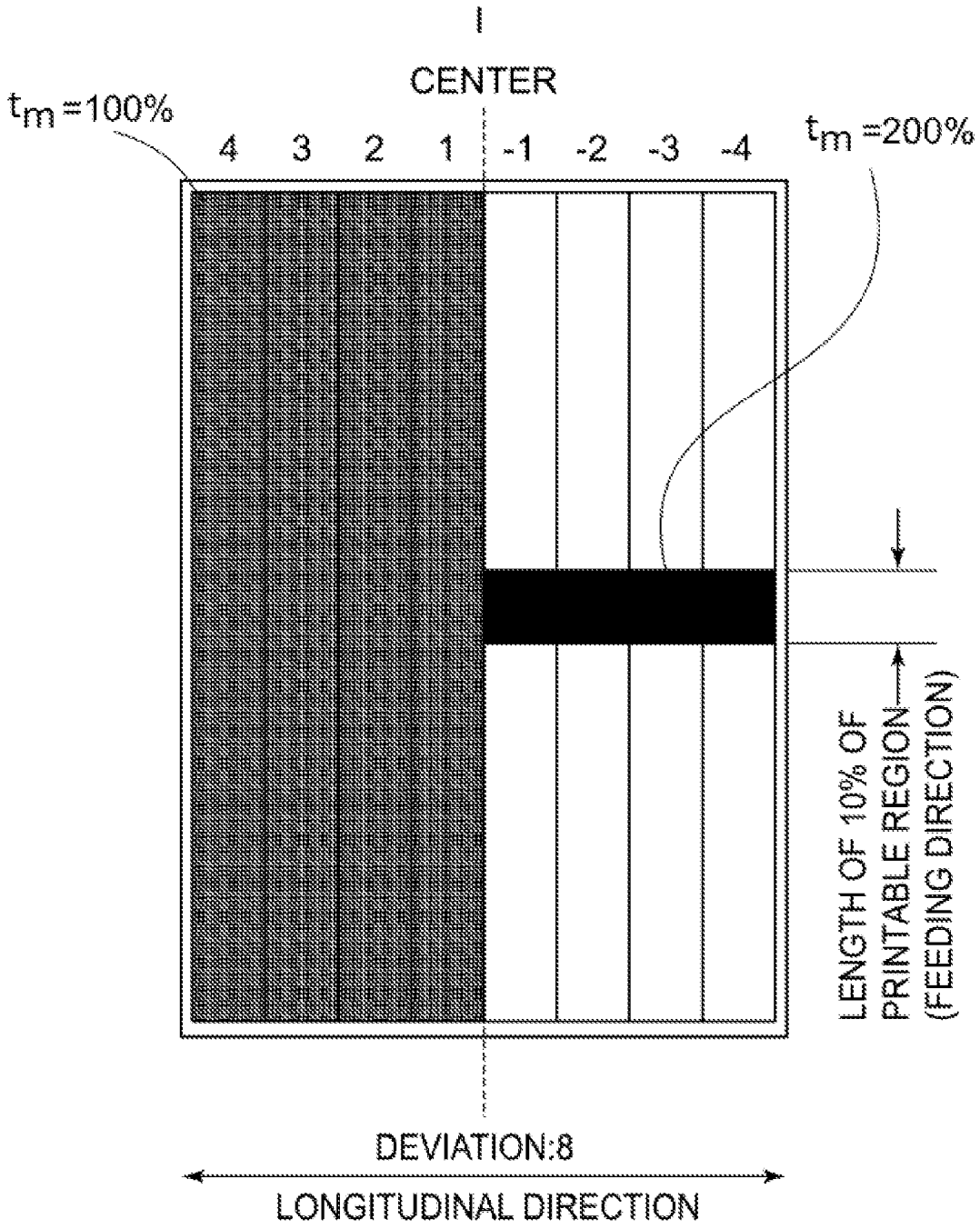

FIG. 11 is an illustration of an image I as an image example in the Third Embodiment.

Figure 12:
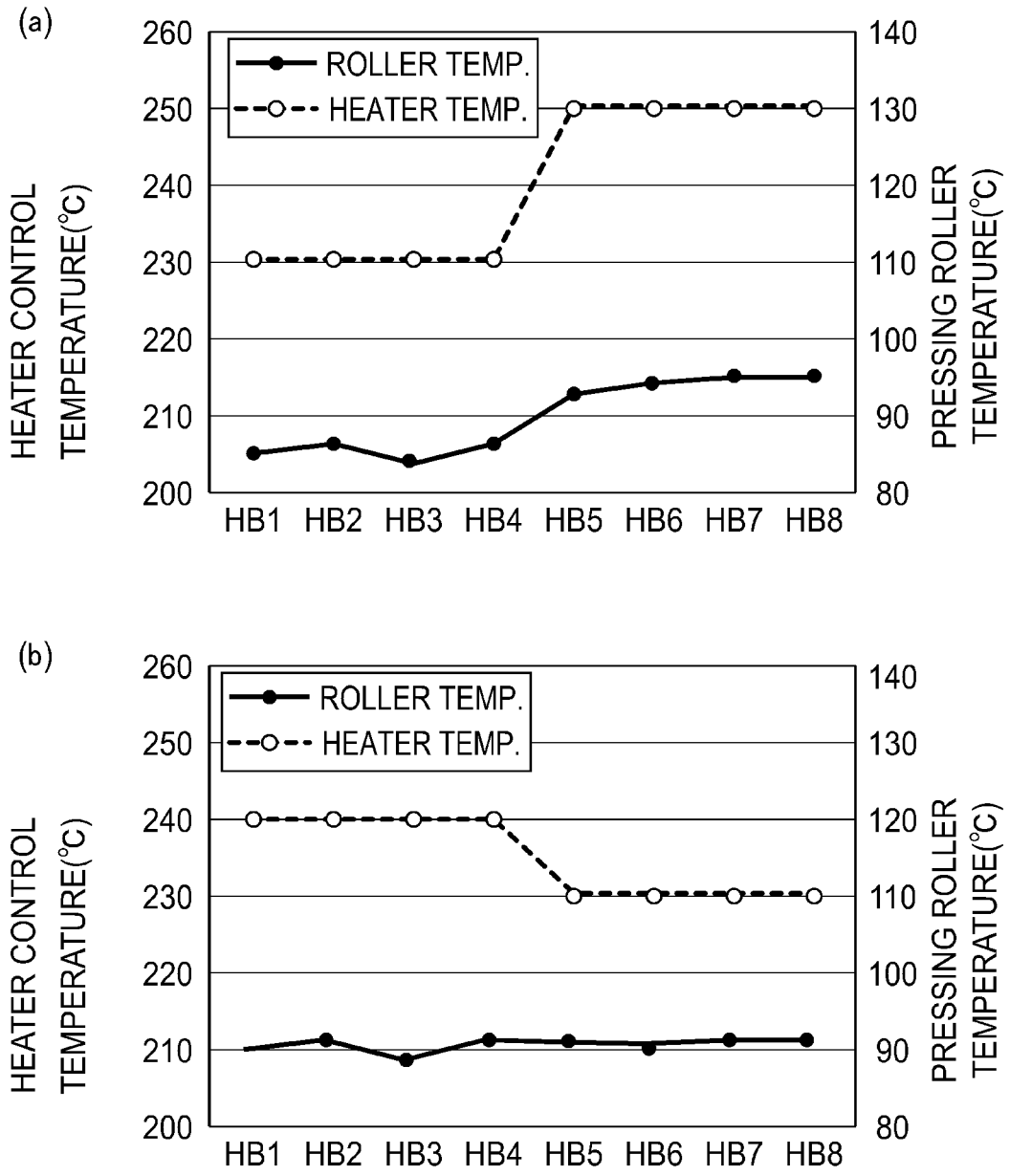

Parts (a) and (b) of FIG. 12 are graphs each showing a relationship between a control temperature and a pressing roller temperature for each of heat generating members for illustrating an effect of the Third Embodiment.

DESCRIPTION OF EMBODIMENTS

Embodiments of the present invention will be described with reference to the drawings.

First Embodiment (Image Forming Apparatus)

Figure 1:
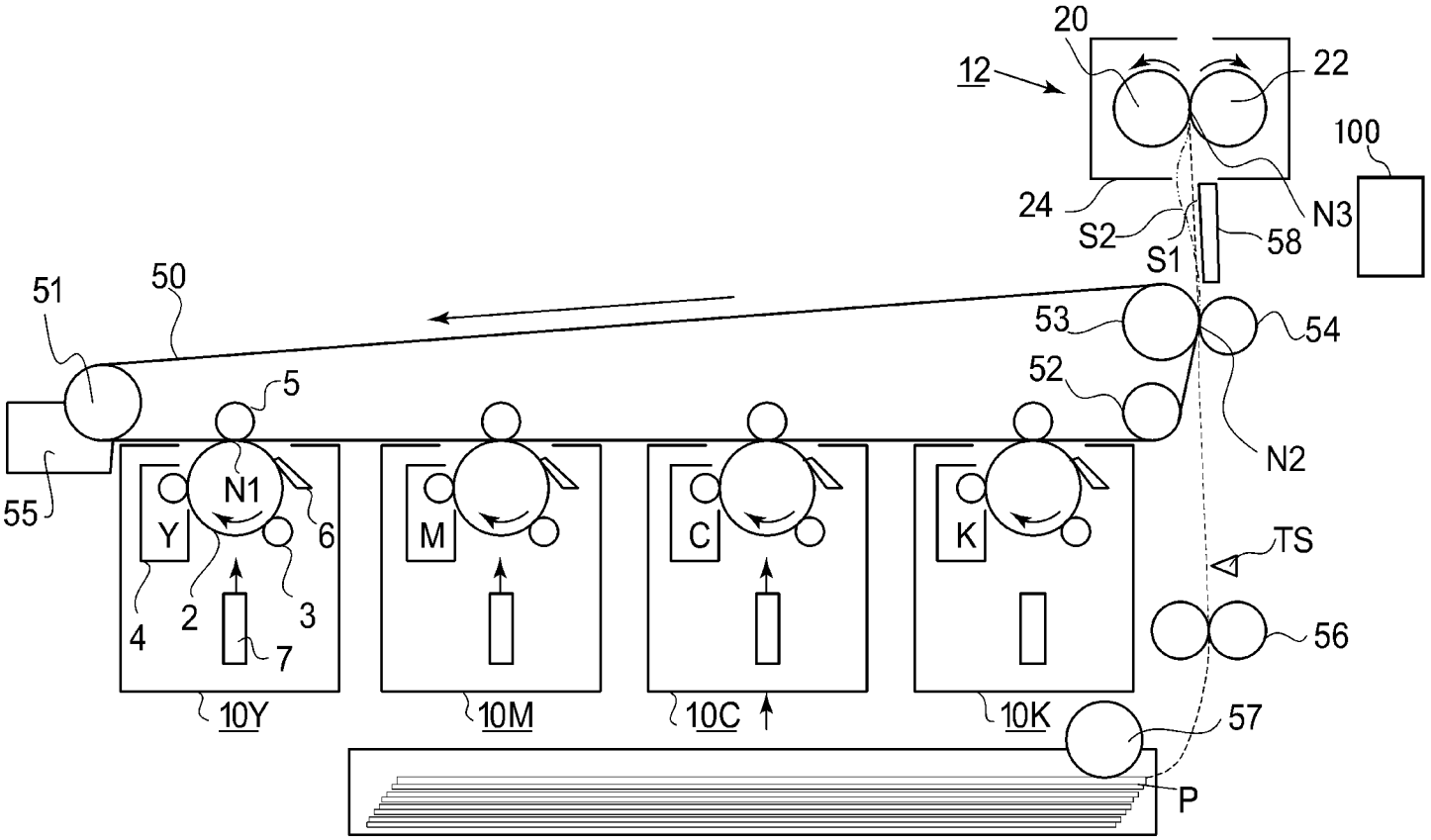
FIG. 1 is a schematic structural view of an image forming apparatus according to an embodiment of the present invention.

FIG. 1 is a schematic structural view showing an image forming apparatus according to the present invention. This image forming apparatus is a tandem full-color printer of an electrophotographic type. This image forming apparatus includes four image forming portions (image forming units 10Y, 10M, 10C and 10K) which are disposed in series with certain intervals. In the following, the image forming portion (unit) 10Y for yellow will be described as an example.

Each of the image forming portions includes a photosensitive drum 2, and, at a periphery of the photosensitive drum 2, each of the image forming portions includes a charging roller 3, a developing device 4, a primary transfer roller 5, and a drum cleaning device 6. Below between the charging roller 3 and the developing device 4, an exposure device 7 is provided. In the respective developing devices 4, yellow toner Y, magenta toner M, cyan toner C, and black toner K are accommodated. The photosensitive drum 2 is rotationally driven at a predetermined speed in an arrow direction by an unshown driving motor, and, in a rotation process thereof, the photosensitive drum 2 is electrically charged uniformly by the charging roller 3.

Laser light modulated correspondingly to an image signal is outputted from the exposure device 7, and the photosensitive drum 2 is selectively subjected to scanning exposure to the laser light, so that an electrostatic latent image is formed. The developing device 4 visualizes this electrostatic latent image into a toner image by depositing the toner, which is a developer, on the photosensitive drum 2. The toner image formed on the photosensitive drum 2 is transferred, at a primary transfer nip N1, from the photosensitive drum 2 onto an intermediary transfer belt 50 rotating in contact with the photosensitive drum 2.

Toner images corresponding to four colors are successively transferred superposedly onto the intermediary transfer belt 50 in the same procedure, so that a full-color toner image is formed on the intermediary transfer belt 50. That is, the intermediary transfer belt 50 carries toner images for a color image to be formed on a recording material P. The intermediary transfer belt 50 is driven while being stretched by stretching rollers 51, 52 and 53 and is rotated in a direction indicated by an arrow.

On the other hand, the recording material P set in a sheet (paper) feeding cassette is fed by a sheet (paper) feeding roller 57 and is conveyed to a registration roller pair 56. A leading end of the recording material P conveyed to the registration roller pair 56 is detected by a top sensor TS provided immediately after the registration roller pair 56. The recording material P is conveyed to a transfer nip (secondary transfer nip) N2 by the registration roller pair 56 while being timed to a toner image position on the intermediary transfer belt 50 depending on detection of the leading end of the recording material P by an unshown control means.

Then, by a secondary transfer roller 54 to which a secondary transfer bias is applied, the toner images for the full-color image are secondary-transferred altogether onto the recording material P. The recording material P on which the full-color toner image t is formed is conveyed to a fixing device (image heating device) 12 as a fixing portion.

In a fixing nip N3 between a fixing film 20 (which is a rotatable heating member) and a pressing roller 22 (which is a rotatably driving member), the full-color toner image t is heated and pressed, and thus is melt-fixed on the surface of the recording material P. Thereafter, the recording material P is discharged to an outside of the image forming apparatus, and the fixed full-color image results in an output image. Then, a series of image forming operations is ended.

Incidentally, after the above-described primary transfer, primary transfer residual toner remaining on the photosensitive drum 2 is removed and collected by the drum cleaning device 6. Further, after the secondary transfer, secondary transfer residual toner remaining on the intermediary transfer belt 50 is removed and collected by a belt cleaning device 55.

The image forming apparatus of this embodiment is provided with an unshown temperature and humidity sensor for detecting a temperature and a humidity of an environment in which the image forming apparatus is installed. The respective processes of the image formation described above are controlled depending on the detected temperature and humidity.

Further, a controller 100 in the image forming apparatus of this embodiment includes a calculating means (acquiring means) and calculates (acquires) an average image print ratio from image information data sent from an external host device. Here, the print ratio refers to a ratio (proportion) of an area of the toner image t occupied per unit area, and for example, a solid black image is 100% in print ratio and a solid white image is 0% in print ratio. Further, depending on the calculated print ratio, the controller 100 carries out a dew condensation slip suppressing control, which is described later.

In FIG. 1, a broken line indicated by 51 represents a basic path of flow along which the recording material P moves during the above-described image forming operation. A chain double-dashed line indicated by S2 represents a path of flow along which the recording material P moves in the case when the dew condensation slip occurs in the fixing device 12.

When the dew condensation slip occurs, a speed of the recording material P fed through the fixing nip N3 in the fixing device 12 becomes slow, but a speed of the recording material P through the secondary transfer nip N2 is unchanged. For this reason, between the transfer nip N2 and the fixing nip N3, the recording material P slacks toward a side opposite from a guiding member 58, so that the recording material P moves along a swelling (rising) path of flow S2. When the slack recording material P contacts a frame 24 or the like of the fixing device 12, a problem such as image rubbing arises.

(Fixing Device)

Figure 2:
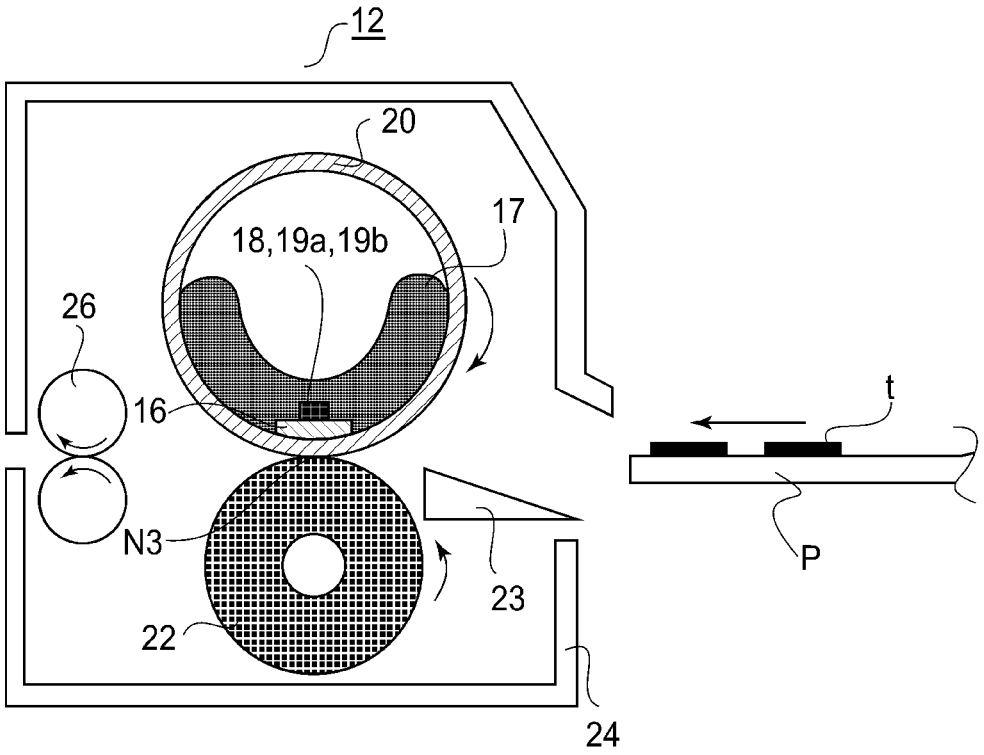
FIG. 2 is a schematic sectional view of a fixing portion (image heating portion) of a film heating type.

FIG. 2 is a schematic sectional view of the fixing device 12. The fixing device 12 heat-fixes the toner image t on the recording material P, and includes a fixing heater 16 as a heat generating member including an energization heat generating resistor layer and includes a fixing film 20 movable and rotatable together with the recording material P. The heater 16 functions as a heating means for heating the fixing nip through the fixing film 20.

The fixing device 12 further includes the pressing roller 22 press-contacted to the fixing film 20 and has a constitution in which the toner image t on the recording material P is heat-fixed in the fixing nip formed by the fixing film 20 and the pressing roller 22.

The fixing film 20 is a cylindrical (endless belt-shaped) member including an elastic layer formed on a belt-shaped member. In this embodiment, the endless belt is 70 μm thick polyimide layer (belt base material) formed in a cylindrical shape. An about 250 μm-thick silicone rubber layer (elastic layer) is formed on the belt base material. Further, on the silicone rubber layer, a 30 μm-thick PFA resin tube (outermost layer) is coated.

The heater 16 is held by a heater holder 17. The heater holder 17 is a member having a heat-resistant property and rigidity, and the heater 16 is provided at a lower surface of the heater holder 17 so as to extend along a longitudinal direction of the heater holder 17. The fixing film 20 is loosely fitted around the heater holder 17. The heater holder 17 is formed of a liquid crystal polymer high in heat-resistant property and performs the function of guiding the fixing film 20 while holding the fixing heater 16.

Figure 3:
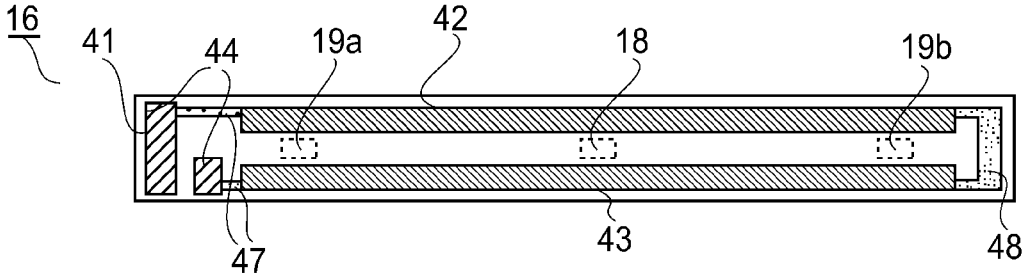
FIG. 3 is a schematic view of a fixing heater, with respect to a longitudinal direction, in First and Second Embodiments.
Figure 4:
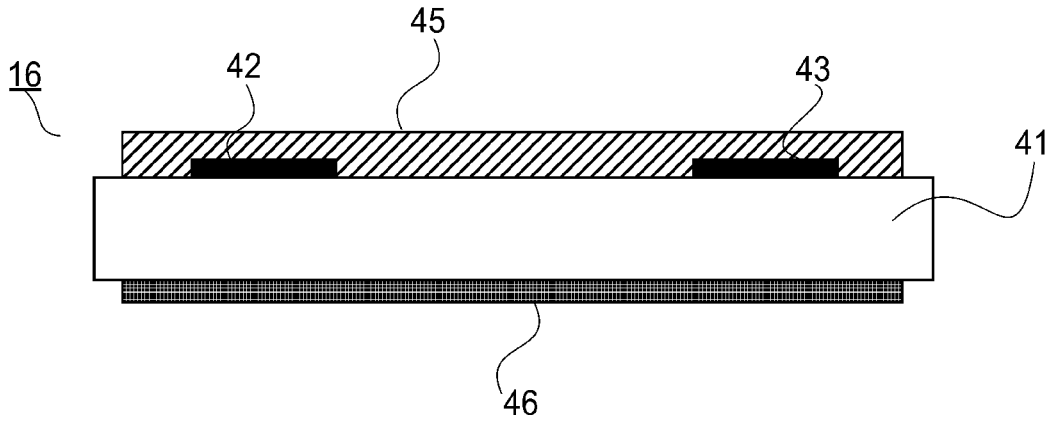
FIG. 4 is a sectional view of the fixing heater in the First and Second Embodiments.

FIG. 3 is a schematic view of the heater 16 as seen from an upper side in FIG. 2 (hereafter, this side is referred to as a back surface), and FIG. 4 is a sectional view of the heater 16.

The heater 16 includes an aluminum nitride substrate 41 which is an elongated thin ceramic substrate, and on the back surface thereof, heat generating resistors 42 and 43 printed by screen printing are provided. The heater 16 further includes electrode portions 44 and electroconductive portions 47 and 48. The heat generating resistors 42 and 43 are connected to the electrode portions 44 by the electroconductive portions 47, and are connected to each other by the electroconductive portion 48 so as to form a series circuit.

The heat generating resistors 42 and 43 and the electroconductive portions 47 and 48 are protected by a glass coat 45 applied thereon, so that an insulating property is ensured. On a downward surface of the heater 16 (hereafter, this surface is referred to as a front surface), a sliding layer 46 made of glass is provided at a contact surface with the fixing film 20. Electric power is supplied from a circuit of a power source (unshown) to the electrode portions 44, so that the heat generating resistors 42 and 43 generates heat and thus the heater 16 quickly increases in temperature over an entire region with respect to a longitudinal direction thereof.

The pressing roller 22 includes a silicone rubber layer and a PFA resin tube layer on a core metal made of stainless steel. This pressing roller 22 is held by the device frame 24 via bearing so as to be rotatable. On this pressing roller 22, a fixing film unit comprising the heater 16, the heater holder 17, the fixing film 20 and the like is disposed in parallel and contact with the pressing roller 22 with the heater 16 downward.

Opposite end portions of the heater holder 17, with respect to the longitudinal direction of the heater 16, are urged toward the pressing roller 22 by a force of 12.5 kgf of one side, i.e., a total pressure of 25 kgf. As a result, the fixing nip N3 with a predetermined width necessary to heat-fix the toner image t on the recording material P is formed.

In this embodiment, a temperature of the heater 16 is detected by a main thermistor 18 and sub-thermistors 19*a* and 19*b*. As a specific arrangement of these thermistors, the main thermistor 18 is disposed at a center position of the heater 16 with respect to the longitudinal direction of the heater 16, and the sub-thermistors 19*a* and 19*b* are disposed at positions which are located equidistantly from the center position and which are located in the neighborhood of opposite end portions of the heater 16 (broken line portions of FIG. 3).

In this embodiment, the main thermistor 18 and the sub-thermistors 19*a* and 19*b* are disposed in contact with the back surface of the heater 16 and detect the temperature of the back surface of the heater 16, but positions of these thermistors are not limited thereto. For example, the thermistors may also be disposed in contact with a back surface of the fixing film 20 and may also detect the temperature of the back surface of the fixing film 20.

In FIG. 2, an entrance guide 23 and a fixing discharging roller 26 are assembled with the frame 24. The entrance guide 23 performs the function of guiding the recording material P so that the recording material P passes through the secondary transfer nip N2 is accurately guided to the fixing nip N3. The entrance guide 23 of this embodiment is formed of polyphenylene sulfide (PPS).

The pressing roller 22 is rotationally driven by an unshown driving means at a predetermined peripheral speed in the counterclockwise direction indicated by an arrow. A press-contact frictional force generated by the rotational drive of the pressing roller 22 in the fixing nip N3 between the outer surface of the pressing roller 22 and the fixing film 20, a rotational force acts on the cylindrical fixing film 20. Then, the fixing film 20 is rotated by the rotational force around the heater holder 17 in the clockwise direction indicated by an arrow while an inner surface thereof intimately contacts and slides on the surface of the fixing heater 16. Onto the inner surface of the fixing film 20, grease is applied, so that a sliding property between the heater holder 17 and the inner surface of the fixing film 20 is ensured.

The pressing roller 22 is rotationally driven, and, with the rotational drive of the pressing roller 22, the cylindrical fixing film 20 is in a follower rotational state. As the pressing roller 22 and the fixing film 20 are driven, the fixing heater 16 is energized. In a state in which the fixing heater 16 is increased in temperature and is temperature-controlled at a predetermined temperature, the recording material P carrying an unfixed toner image t is guided along the entrance guide 23 and is introduced into the fixing nip N3. Then, in the fixing nip N3, a toner image carrying surface of the recording material P intimately contacts the outer surface of the fixing film 20 and is nipped and conveyed together with the fixing film 20 through the fixing nip N3.

In this nip-conveying process, heat of the fixing heater 16 is imparted to the recording material P through the fixing film 20, so that the unfixed toner image t is heated and pressed on the recording material P and thus is melt-fixed on the recording material P. The recording material P passes through the fixing nip N3 is curvature-separated from the fixing film 20 and is discharged by a fixing discharging roller pair 26.

(Mechanism of Dew Condensation Slip)

A mechanism of the dew condensation slip will be described in advance of description of a suppressing method of the dew condensation slip in the present invention. In the case when a print job for carrying out image formation by continuously feeding a plurality of recording materials is executed, a driving force from the pressing roller to be rotationally driven is not readily transmitted to the fixing film and the recording material when water vapor generated from the recording materials deposit on the pressing roller, which is the rotatable driving member. As a result, drive from the pressing roller is not readily transmitted to the recording material during feeding in the fixing nip N3, so that the recording material is decelerated.

On the other hand, a feeding speed in the secondary transfer nip N2 is unchanged, and therefore, a slack of the recording material P occurs between the transfer nip N2 and the fixing nip N3. Then, in some cases, "image rubbing" occurs due to contact and rubbing of the unfixed toner image t placed on the slack recording material with various members (for example, the frame 24) in the image forming apparatus and, in some cases, "paper creases" occur due to folding of the slack recording material in the fixing nip N3.

Such dew condensation slip occurs in the case when the pressing roller is liable to form dew, such as when an amount of the water vapor generated from the recording material increases, when the temperature of the pressing roller is low, and the like. Further, in the case of a solid image formed on entire surface of the recording material, the toner image t formed on the recording material on a fixing film side blocks (clogs) an outlet of water vapor generated from the recording material, so that most of the generated water vapor is emitted toward the pressing roller side. For this reason, an amount of the water vapor deposited on the pressing roller surface increases, and results in a severer condition for the dew condensation slip.

(Dew Condensation Slip in Case of Unevenness in Print Ratio with Respect to Recording Material Widthwise Direction (Direction Perpendicular to Recording Material Feeding Direction))

Next, an occurrence of the dew condensation slip in the case when there is unevenness in print ratio will be described. In the case when the unevenness in print ratio exists, in a region where the print ratio is high, the amount of the water vapor depositing on the pressing roller surface increases in a region where the print ratio is high and a feeding force of the pressing roller in that region decreases. That is, unevenness of the feeding force of the pressing roller occurs depending on unevenness of the print ratio.

Figure 5:
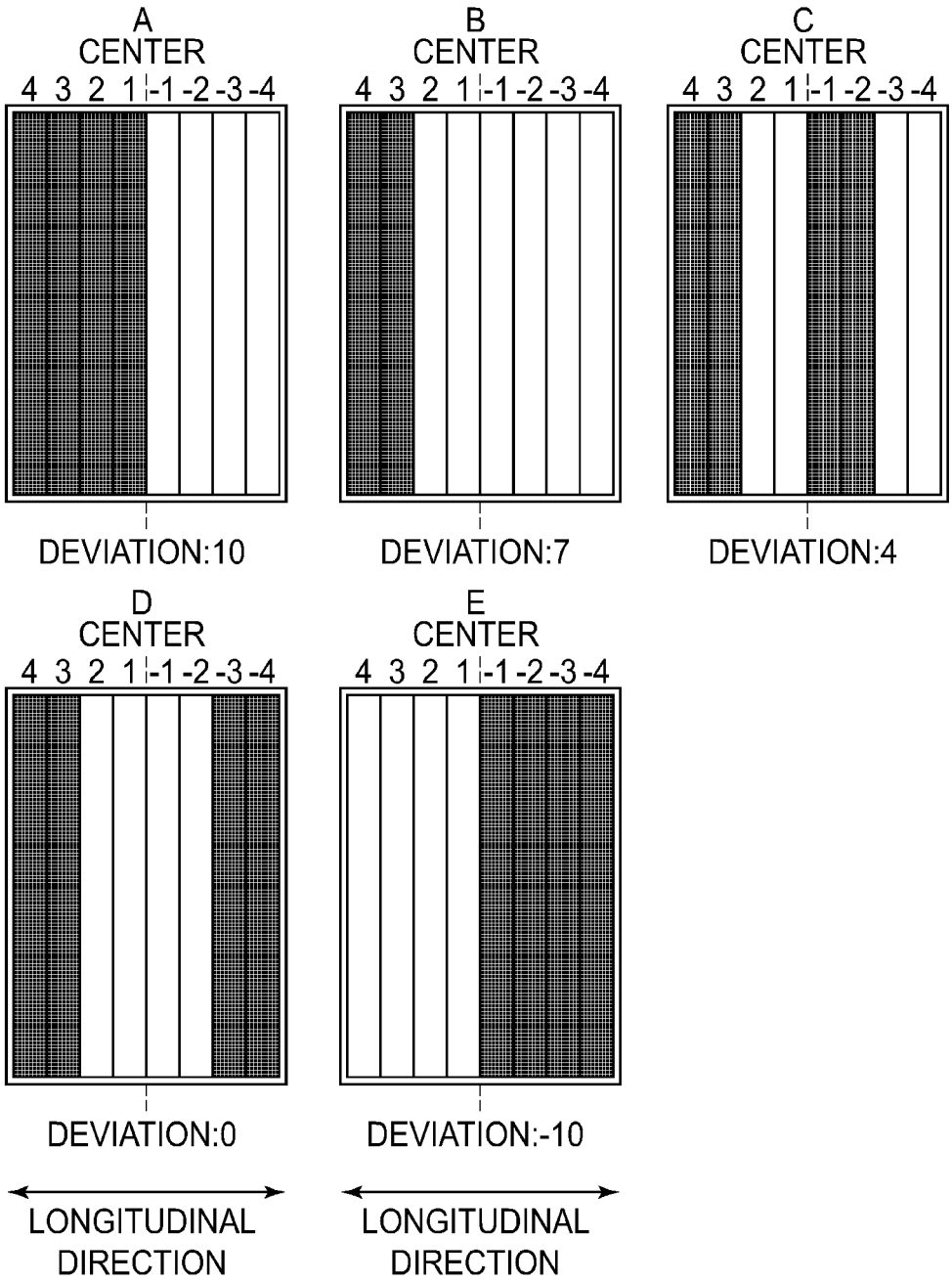
FIG. 5 is an illustration of images of −10 to 10 in image unevenness.

A relationship between the unevenness of the print ratio and the unevenness of the feeding force will be described using FIGS. 5 and 6. FIG. 5 shows examples of five images of A to E prepared by variously changing a print position of a vertical and image of 25 mm in width and 100% (solid) in print ratio. Numerical values shown under the five images of A to E are represent a degree of the unevenness of the print ratio, and hereafter are referred to as "image unevenness" represented by x. The image unevenness x shown in FIG. 5 is defined as follows.

(1) A print region of 200 mm of A4-size paper is divided in 8 regions each having a width of 25 mm.

(2) In order to perform weighting of 8 divided regions, 8 indices of 4, 3, 2, 1, −1, −2, −3 and −4 are assigned to the 8 divided regions, respectively, from a left side end of each image.

(3) As regards an average print ratio of each of the 8 divided regions, 1 is given as a maximum. In the case when the average print ratio is 100%, the average print ratio is represented by 1, and in the case when the average print ratio is 50%, the average print ratio is represented by 0.5.

(4) The numerical value of the weighting given in (2) for each of the 8 divided regions and the numerical value given in (3) are multiplied by each other, and all the numerical values of the resultant 8 divided regions are added up and an image unevenness is acquired.

The above-described calculating means (acquiring means) in the controller 100 (FIG. 1) also functions as a first acquiring portion for acquiring an image unevenness between one side and the other side of the recording material with respect to a widthwise direction.

FIG. 5 shows that the image is shifted toward a left side on the drawing sheet thereof with a larger positive numerical value acquired in (1) to (4) and that the image is shifted toward a right side with a large negative numerical value acquired in (1) to (4).

Next, the respective images of A to E are continuously printed on 20 sheets by the image forming apparatus of this embodiment, and a left-right difference in feeding force for a fifth sheet in the fixing nip was checked. The recording material feeding force was measured by the following method. A marking member is embedded in the pressing roller surface so that a mark on the recording material is made at a rotation pitch of the pressing roller during passing of the recording material through the fixing nip. By measuring a distance of the mark, which is every one-full-circumference (turn) of the pressing roller, it is known that how many recording materials are fed every one-full-circumference of the pressing roller.

Further, marking members are embedded in the pressing roller surface at two positions corresponding to opposite end portions of the recording material with respect to the widthwise direction of the recording material.

In this embodiment, an outer diameter of the pressing roller is 25 mm, and therefore, an outer circumference of the pressing roller is about 78.5 mm. When the pressing roller feeds the recording material without slipping, a distance between the markings embedded in the back surface of the recording material should be 78.5 mm, so that an A4-size recording material of 297 mm in large with respect to the recording material feeding direction is fed by a little less than 4 full circumferences. That is, the markings are made on the A4-size recording material at three or four positions.

From the markings, a recording material feeding distance by the pressing roller corresponding to two or three full circumferences of the pressing roller is known, and therefore, a recording material feeding material per one-full-circumference of the pressing roller is calculated from a measurement result thereof. Then, a numerical value obtained by subtracting the recording material feeding distance per one-full-circumference of the pressing roller at a right-side end portion from the recording material feeding distance per one-full-circumference of the pressing roller at a left-side end portion is defined as a "feeding force left-right difference".

With a large positive value thereof, the left-side feeding force is relatively smaller than the right-side feeding force, and with a larger negative value thereof, the left-side feeding force is relatively larger than the right-side feeding force. For example, in the case when this value is 0.5, it means that the left-side feeding distance is relatively shorter than the right-side feeding distance by 0.5 mm.

The above-described image forming apparatus was installed in an environmental test room of 30° C. in temperature and 80% RH in humidity (hereafter referred to as an HH test room), and printing of images on 20 sheets of A4-size paper ("GFR-070", basis weight of 70 g/m$^3$) which were left standing for 2 days in the HH test room was carried out. A control temperature by the thermistor 18 was 230° C., and a recording material feeding speed was 300 mm/sec, and a sheet interval was set at 10 mm.

Here, the sheet interval is an interval from after an end of feeding of a preceding recording material in the fixing nip until a start of feeding of a subsequent recording material to the fixing nip.

In advance of an experiment, when a water content of the paper (GFR-070) left in the HH test room was measured by a water content meter ("Moistrex MX-8000", manufactured by NDC Infrared Engineering Ltd.) was checked, the paper contained water of 9.2%. Further, for comparison, the water content was 5.7% when the water content of the paper (GFR-070) was measured immediately after opening.

Figure 6:
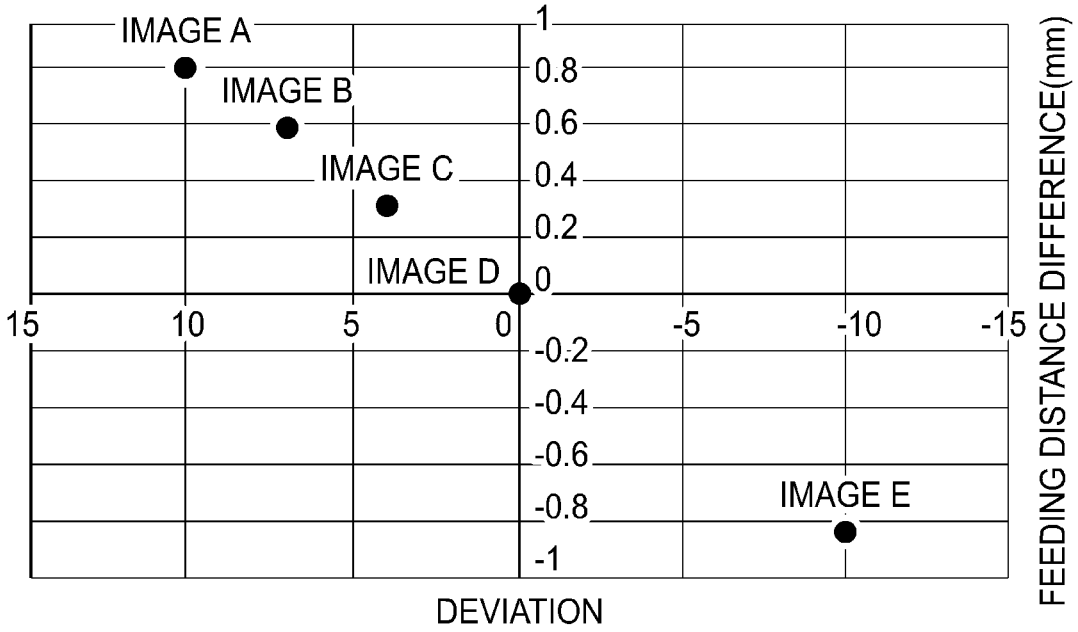
FIG. 6 is a graph showing a relationship between the image unevenness and a left-right difference in feeding distance.

A relationship between the image unevenness x and the feeding force (distance) left-right difference for the images of A to E shown in FIG. 5 is shown in FIG. 6. In printing of the images on the paper (GFR-070), which is paper which was left standing in the HH test room and which is high in water content, with a positively larger image unevenness x, the feeding distance left-right difference became larger in a positive direction. This means that the left-side feeding force is reduced with the unevenness of the image toward the left side as described above.

When the images A with the image unevenness x of 10 were continuously printed on the paper (GFR-070) left standing in the HH test room, on the left side of the image where the feeding force is reduced, an amount of a slack of the recording material in a feeding path between the transfer nip and the fixing nip was increased. Further, from a third sheet in the continuous printing, the paper (recording material) contacted the frame 24 of the fixing device 12, and thus image rubbing occurred, so that image rubbing considerably deteriorated in degree thereof occurred on a 10-th sheet and later.

Similarly, when the image B with the image unevenness x of 7 was formed, the image rubbing was observed similarly as in the case when the image A was formed, but a level of the image rubbing was better than the level of the image rubbing when the image A was formed. The feeding distance left-right difference when the image C with the image unevenness x of 4 is formed on the paper (GFR-070) left standing in the HH test room was 0.33 mm, and the feeding distance left-right difference when the image D with the image unevenness x of 0 is formed was 0 mm. In either case of the image C and the image D, the image rubbing was not observed on the sample.

On the other hand, as regards the image E with the image unevenness x of −10, the feeding force is reduced on the right side of the image, so that the slack amount of the recording material increased in the feeding path between the transfer nip and the fixing nip on the right side of the image and thus the image rubbing occurred. In the case when the image is shifted toward the right side, the feeding force on the right side is reduced.

Thus when the image with unevenness in print ratio is printed on the recording material, the left-right difference in feeding force increases depending on the image unevenness thereof and causes the one-side slack of the recording material, so that a problem such as the image rubbing arises.

(Suppression Control of Feeding Force Distribution in Case that Image Unevenness Exists)

Therefore, in this embodiment, in the case when the image unevenness x is large, control for decreasing the unevenness of the feeding force distribution of the pressing roller is carried out. Specifically, before image formation is carried out during execution of continuous printing, a print ratio as an area ratio of image information is calculated by the calculating means. Then, by the print ratio of the recording material P, in the case when the image unevenness x is larger than a threshold (reference value) at which there is a liability of an occurrence of an image defect, a sheet interval increase control is carried out by the controller 100 (FIG. 1). That is, image writing timing on subsequent recording materials P which are fed as a second sheet and later and feeding start timing of the recording materials P is delayed.

As a result, a surface temperature of the pressing roller is increased in a period in which is the fixing nip is positioned in a sheet interval between a preceding recording material and a subsequent recording material thereof and thus the surface temperature of the pressing roller is increased in advance before water vapor generates from the subsequent recording material, whereby dew condensation on the pressing roller is prevented and thus the subsequent recording material P is prevented from slipping.

Here, in the sheet interval, the heater 16 may preferably be kept on. In the case when the sheet interval increase control in this embodiment is carried out, the pressing roller surface can be warmed in the nip when the heater is kept on in the sheet interval.

In this embodiment, the image unevenness x=5.5, which is a value between the image unevenness x of the image B on which the image rubbing occurred and the image unevenness x of the image C on which the image rubbing did not occur, is set at the threshold, and, in the case when an image with the image unevenness x larger than this threshold is detected, the sheet interval between the preceding paper and the subsequent paper is increased from 10 mm to 314 mm. Further, in the case when it is predicted that the water content of the recording material P is large, this control is carried out, and as a condition of the control, a detection result of a temperature and humidity sensor provided in the image forming apparatus such that the temperature is higher than 27° C. and the humidity is higher than 70% RH was employed.

When the above-described control was carried out in continuous printing of the images A with the image unevenness x of 10 on 20 sheets of the paper (GFR-070) left standing in the HH test room, the one-side slack of the recording material on the left side did not occur and thus the image rubbing did not occur.

As described above in this embodiment, the control is carried out so as to increase the sheet interval in the case when an image with a large image unevenness x is detected, so that it becomes possible to provide an image forming apparatus with no occurrences of image rubbing and no paper creases.

That is, in this embodiment, in a situation that the print ratio unevenness with respect to a widthwise direction of the recording material is large and thus unevenness of the feeding force of the pressing roller can occur, the pressing roller surface can be warmed as the sheet interval is increased depending on a magnitude of the degree of the unevenness of the print ratio. For this reason, the dew condensation on the pressing roller can be suppressed. As a result, even in the case when the unevenness of the print ratio is large, it becomes possible to prepare the image forming apparatus with no occurrences of the image rubbing and no paper creases by reducing the unevenness of the feeding force in the fixing nip.

Second Embodiment

In First Embodiment, the control is carried out so as to increase the sheet interval in the case when the image with the large image unevenness x is detected, whereby an effect of preventing the occurrence of the image rubbing was obtained. However, the control was such that the sheet interval was uniformly increased in the case when the image unevenness x exceeded a certain threshold, and therefore, depending on the magnitude of the image unevenness x, a state in which the sheet interval was increased more than necessary was formed. Therefore, in this embodiment, as the sheet interval increase control, the sheet interval is stepwisely changed depending on the image unevenness x.

In First Embodiment, in the case when the image unevenness x exceeded 5.5, the sheet interval was increased to 314 mm. On the other hand, in this embodiment, depending on an amount of the image unevenness x which exceeded 5.5, the sheet interval is stepwisely changed. When the image unevenness x is 5.5 or less, the sheet interval is not increased and is kept at 10 mm. When the image unevenness x is 10, the sheet interval is changed to 314 mm, which is a sheet interval value at which no problem occurs, as discussed above in First Embodiment. In a range between 5.5 and 10 of the image unevenness x, the sheet interval is controlled depending on the magnitude of the image unevenness x as shown in Table 1 below.

TABLE 1

| Image unevenness x | Sheet interval (mm) |
|---|---|
| $x \leq 5.5$ | 10 |
| $5.5 < x \leq 7$ | 111 |
| $7 < x \leq 8$ | 179 |
| $8 < x \leq 9$ | 246 |
| $x \leq 10$ | 314 |

Figure 7:
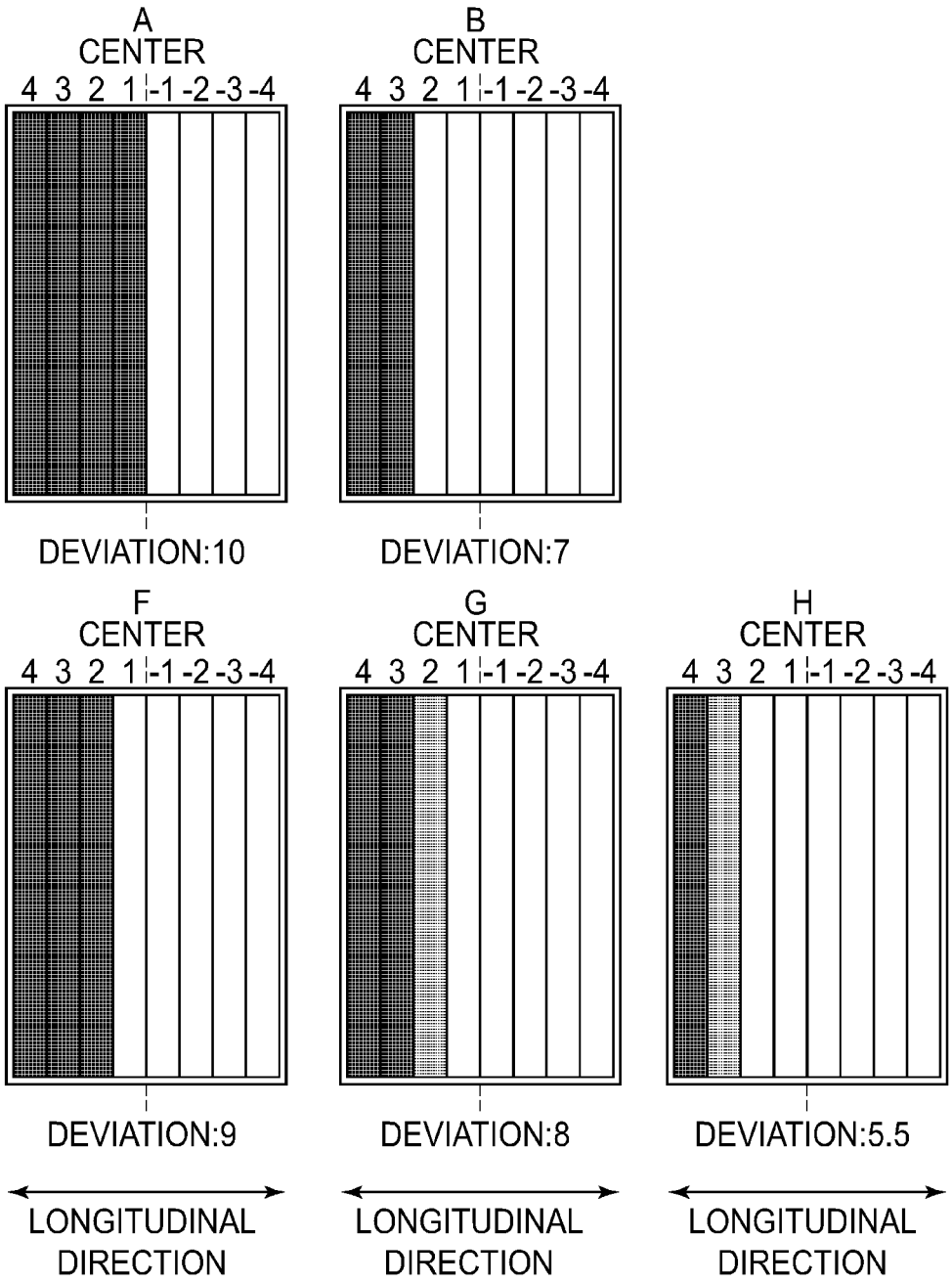
FIG. 7 is an illustration of images of 5.5 to 10 in image unevenness.

In order to confirm an effect of the control in this embodiment, the continuous printing was carried out using the images A, B, F, G, and H shown in FIG. 7. Each of the images A, B, and F is a combined image of solid black vertical bands with the print ratio of 100%, and each of the images G and H is a combined image of the solid black vertical band(s) with the print ratio of 100% and a halftone black band with the print ratio of 50%. The image unevenness x of each of the images is 10 for the image A, 7 for the image B, 9 for the image F, 8 for the image G and 5.5 for the image H. The condition of the continuous printing other than the images is the same as the condition in First Embodiment.

In this continuous printing, the control in which the sheet interval is stepwisely increased depending on the image unevenness x, which is a characteristic feature of this embodiment, was carried out on the basis of Table 1. Then, with respect to all the images A, B, F, G and H, the one-side slack of the recording material P between the transfer nip and the fixing nip did not occur, and the occurrence of the image rubbing was also not observed.

In the case when the image unevenness x is small, the feeding distance left-right difference decreases correspondingly. For this reason, even in a small increase amount in sheet interval, the feeding force left-right difference can be eliminated, so that the problem, such as the image rubbing, can be prevented.

From a verification result described above, it turned out that even when the sheet interval is increased stepwisely depending on the image unevenness x, the one-side slack is eliminated and thus the occurrence of the image rubbing can be prevented. That is, in the case when the image unevenness x is small, even in a small increase amount of the sheet interval, the image defect can be avoided, and therefore, it becomes possible to carry out control without unnecessarily lowering a throughput.

As described above, by carrying out the control in this embodiment, it becomes possible to provide an image forming apparatus capable of preventing the image rubbing without unnecessarily lowering the throughput.

Third Embodiment

In the heaters of the fixing devices described in First and Second Embodiments, a heat generation distribution with respect to the longitudinal direction of the heater was not able to be switched. In this embodiment, an image forming apparatus which includes a heater including a heat generating block divided into a plurality of heat generating blocks with respect to the longitudinal direction (hereafter, this heater is referred to as a division heater) will be described.

In the image forming apparatus of this embodiment, the heat generating blocks (heat generating members) of the division heater can be independently controlled depending on acquired image information. A constitution is employed in which heating is made at a high temperature in a region in which the print ratio, with respect to the widthwise direction of the recording material, is high and in which heating is made at a low temperature in a region in which the print ratio with respect to the widthwise direction of the recording material is In this constitution, a necessary heat quantity can be supplied to a necessary region.

According to this constitution, a region in which the print ratio is high and the amount of the dew concentration on the pressing roller is selectively heated at a high temperature (for example, 230° C. as shown in part (b) of FIG. 12 described later) in the continuous printing of the image with a large image unevenness.

Figure 8:
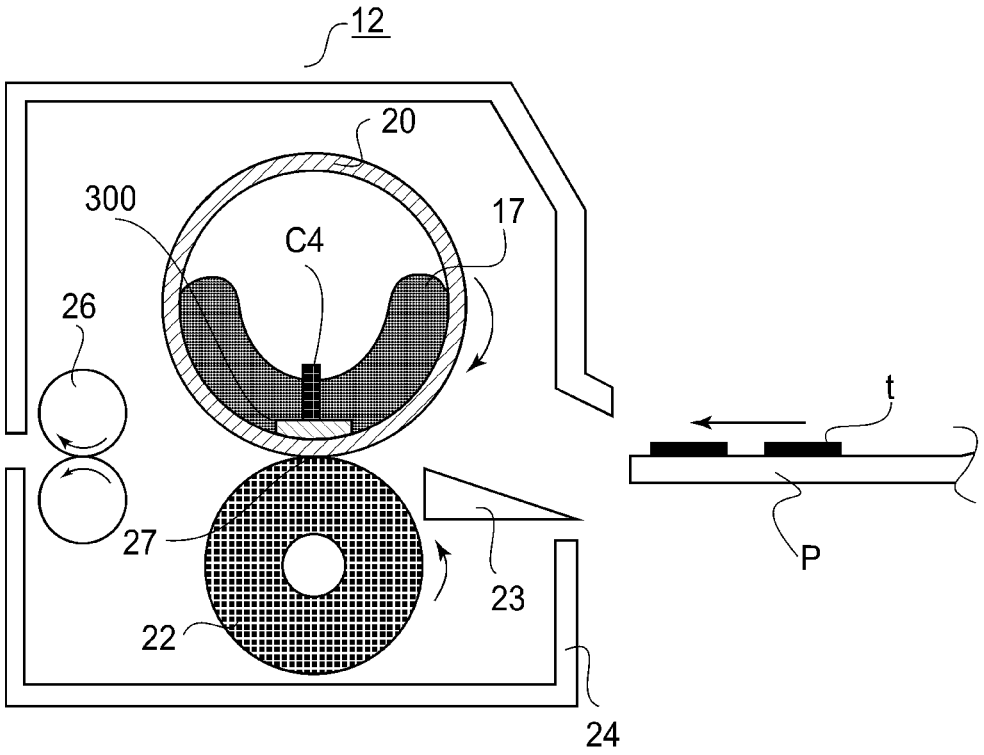
FIG. 8 is a schematic sectional view of a fixing portion (image heating portion) using a division heater 300 in a Third Embodiment.

FIG. 8 is a schematic sectional view of a fixing device 12 in this embodiment. A constitution except for a division heater 300 and an electrical contact C4 is the same as the constitution of the fixing device (FIG. 2) described in First Embodiment, and therefore, will be omitted from description.

Parts (a) and (b) of FIG. 9 are schematic views of the division heater 300 in this embodiment, in which part (a) of FIG. 9 is a sectional view of the division heater 300 and part (b) of FIG. 9 is a plan view of a back-surface layer 1 ("BACK LAYER 1") and a sliding layer 1 ("SLIDING LAYER 1"). As shown in the plan view of the back-surface layer 1 in part (b) of FIG. 9, the division heater 300 in this embodiment includes heat generating blocks HB1 to HB8. In the following, the division heater 300 will be described by taking the heat generating block HB4 as an example.

Part (a) of FIG. 9 is the sectional view of a position of the heat generating block HB4 indicated by a broken line X in part (a) of FIG. 9. The division heater 300 includes first electroconductive members 301 (301*a*, 301*b*) provided along a longitudinal direction of the division heater 300 on a back surface of a substrate 305 made of ceramic. Further, on the substrate 305, the division heater 300 includes a second electroconductive member 303 provided along the longitudinal direction of the division heater 300 at a position different from positions of the first electroconductive members 301 with respect to a widthwise direction of the division heater 300. Further, the division heater 300 includes a heat generating member 302 which is provided between the first electroconductive member 301 (301*a* or 301*b*) and the second electroconductive member 303 and which generates heat by electric power supplied via the first electroconductive member 301 and the second electroconductive member 303.

The heat generating member 302 is separated into a heat generating member 302*a* provided on an upstream side of a feeding direction of the recording material P and a heat generating member 302*b* provided on a downstream side of the recording material feeding direction. Further, an insulating layer 307 (glass in this embodiment) for covering the heat generating member 302, the first electroconductive members 301, and the second electroconductive member 303 is provided as a back-surface layer 2 ("BACK LAYER 2") of the division heater 300 so as to avoid an electrode EL.

As the back-surface layer 1 of the division heater 300 shown in part (b) of FIG. 9, the 8 heat generating blocks HB1 to HB8 each comprising a set of the first electroconductive members 301, the second electroconductive member 303 and the heat generating member 302 are provided with respect to a longitudinal direction of the division heater 300. In this embodiment, dimensions of all the heat generating blocks with respect to the longitudinal direction of the heater are the same (but may also be not necessarily be required to be the same). The electrode EL and portions E2-1 and E2-2 are used for supplying electric power from an unshown control circuit to the heat generating blocks. The heat generating blocks independently include the electrode EL, and electric power supplied to at least one heat generating block and electric power supplied to another heat generating block are independently controllable.

The sliding layer 1 on the front surface side of the division heater 300 is provided with a thermistor TR for detecting a temperature of the heat generating block of the division heater 300. Each of all the heat generating blocks HB1 to HB8 is provided with the thermistor TR, and therefore, it is possible to detect temperatures of all the heat generating blocks.

In order to energize the thermistor TR, an electroconductive member ET for detecting a resistance value of the thermistor TR and a common electroconductive member EG of the thermistors TR are formed. As a sliding layer 2 ("SLIDING LAYER 2") on the front surface side of the division heater 300, a sliding layer 308 (glass in this embodiment) is provided.

Next, a fixing temperature setting method of the respective heat generating blocks of the division heater 300 depending on the image information will be described. In this embodiment, the controller 100 functions as also a second acquiring portion for acquiring, from the image information, a toner amount information in a plurality of regions of the recording material.

In this embodiment, a control temperature T of each of the heat generating blocks of the division heater 300 is determined on the basis of a maximum toner amount information $t_m$. Here, the maximum toner amount information $t_m$ refers to a maximum one of toner amounts in areas each having a size of 18×18 dots in an entirety of the image print region.

The maximum toner amount information $t_m$ is calculated in the following manner. The image print region is area-divided into a plurality of minute regions each having several-dot size, and density information of image data is detected for each of the areas. This operation is repeated in the entirety of the image print region with no gap. The image forming apparatus of this embodiment has a resolution of 600 dpi, and the minute region having the several-dot size is a size of 18×18 dots. When a minimum print ratio per single color of the toner is 0% and a maximum print ratio per single color of the toner is 100%, an upper limit of the maximum print ratio at which the image forming apparatus of this embodiment is capable of printing images of a plurality of colors superposedly on the recording material was 200%. When the upper limit of the toner amount (maximum print ratio) is 200%, a sufficient color range as a color range of the image forming apparatus can be covered.

In the case when the maximum toner amount information $t_m$ is 100% or less, the control temperature T of the heat generating block is set at 230° C. In the case when the maximum toner amount information $t_m$ exceeds 180%, the heat generating block control temperature is set at 250° C., and in the case when the maximum toner amount information $t_m$ is between 100% and 180%, the heat generating block control temperature is set by a relational expression of $T=0.25\times t_m+205$. That is, a relationship between the maximum toner amount information $t_m$ ("MAXIMUM TONER AMOUNT $t_m$") and the control temperature T of each of the heat generating blocks of the division heater 300 is as shown in FIG. 10. The temperature control of the division heater 300 depending on the maximum toner amount information is carried out in all the 8 divided regions, so that the control temperatures of the respective heat generating blocks HB1 to HB8 of the division heater 300 are independently set.

(Sheet Interval Increase Control)

Next, the sheet interval increase control, in the case when the image unevenness is large, which is a first characteristic feature (similar to the characteristic feature of First and Second Embodiments) in this embodiment, will be described. The sheet interval increase control in this embodiment is effective in the case when an image different in left and right average print ratio and maximum toner amount $t_m$, as shown in an image I in FIG. 11 is printed on the recording material.

The image I is divided into 8 regions. Of these regions, in all the 4 regions on a left side, a solid black image with the print ratio of 100% is printed. In all the 4 regions on a right side, a lateral band image having a length of 10% of a printable region with respect to the recording material feeding direction is printed over the 4 regions.

This image is a process black image printed so that a total of print ratios of the images of the four colors of CMYK is 200%. As regards the average print ratio of the 8 divided regions, the average print ratio in the 4 regions on the left side is 100%, and the average print ratio in the regions on the right side is 20%. That is, the image unevenness x of the image I is 8 and is larger than 5.5, and therefore, in this embodiment, similarly as in Second Embodiment, sheet interval increase control of eliminating non-uniformity of the feeding force distribution generating in the longitudinal direction of the fixing device is carried out. The sheet interval is increased to 179 mm which is the same value as the value shown in Table 1.

Here, as regards the control temperatures for the 8 heat generating blocks (heat generating members), the maximum toner amount $t_m$ in the 4 regions on the left side is 100%, so that from the relationship expression of the control temperature shown in FIG. 10, 230° C. is selected as the control temperature when the toner image t is heated (i.e., when the recording material exists in the fixing nip). Further, the maximum toner amount $t_m$ in the 4 regions on the right side is 200%, so that from the relational expression of the control temperature shown in FIG. 10, 250° C. is selected as the control temperature when the toner image t is heated (i.e., when the recording material exists in the fixing nip). For this reason, in the case when the printing of the image I is carried out in the image forming apparatus of this embodiment, the control temperatures of the respective heat generating blocks are set as shown in Table 2.

TABLE 2

| | HB1 | HB2 | HB3 | HB4 | HB5 | HB6 | HB7 | HB8 |
|---|---|---|---|---|---|---|---|---|
| D (%) | 100 | 100 | 100 | 100 | 200 | 200 | 200 | 200 |
| T (° C.) | 230 | 230 | 230 | 230 | 250 | 250 | 250 | 250 |

On the left and right sides of the image I, the division heater 300 is controlled at different temperatures, and therefore, a non-uniformity of a temperature distribution with respect to the longitudinal direction also occurs in the pressing roller to which the heat is transmitted from the division heater 300 through the paper (recording material). When the temperature distribution non-uniformity with respect to the longitudinal direction occurs in the pressing roller, a left-right difference in rotational speed of the fixing film 20 occurs, so that a force for shifting the fixing film 20 toward either one of the left side and the right side with respect to the longitudinal direction is generated (hereafter, this force is referred to as a shifting force). When the shifting force is generated, an excessive stress is exerted on an end potion of the fixing film 20, and when the printing is continued as it is, there is a liability that the fixing film 20 is broken or buckled.

Further, when the temperature distribution non-uniformity occurs in the pressing roller 22, a difference in amount of dew condensation occurs. The dew condensation does not readily occur at a high-temperature portion, and therefore, a feeding force at that portion is not readily reduced. As a result, a large difference is given by the feeding forces in the low-temperature region and high-temperature region, so that image rubbing and paper creases are more liable to occur.

Therefore, the respective heat generating blocks (heat generating members) are controlled at a temperature different from a temperature during the fixing operation (during passing of the paper through the fixing nip) in a period in which the fixing nip corresponds to the sheet interval, which is a second characteristic feature of this embodiment. Specifically, the control temperature is lowered in the sheet interval period for the heat generating block controlled at the high temperature in a period in which the paper passes through the fixing nip. On the other hand, the control temperature is increased in the sheet interval period for the heat generating block controlled at the low temperature in the period in which the paper passes through the fixing nip.

That is, in this embodiment, the control temperatures of the respective heat generating blocks in the period when the sheet interval increased to 179 mm are set depending on the control temperatures of the heat generating blocks during the fixing operation.

Part (a) of FIG. 12 is a plot of the heater control temperature and the pressing roller temperature immediately before a subsequent recording material enters the fixing device 12 when the sheet interval is changed to 179 mm depending on the image unevenness x in continuous printing of the image I on 20 sheets. By the influence of the temperature distribution of the division heater 300 on the pressing roller 22, the temperature distribution occurs in the pressing roller 22, so that a temperature difference among the heat generating blocks HB1 to HB8 was about 10° C. In this case, the one-side slack occurs between the transfer nip and the fixing nip, so that slight image rubbing was observed at the left-side end portion of the image I on a 15-th sheet and later. Further, the shifting force generates, so that the fixing film 20 was shifted toward the left side with respect to the image.

On the other hand, in this embodiment, the respective heat generating blocks are controlled in the following manner in the sheet interval period. That is, a plurality of heat generating blocks are controlled so that the control temperature in the sheet interval period is reduced for the heat generating block which heated a region where the maximum toner amount on the preceding recording material is higher.

Thus, the control was carried out so that the control temperature of the heat generating blocks HB1 to HB4 in the sheet interval period is 240° C. and the control temperature of the heat generating blocks HB5 and HB8 in the sheet interval period is 230° C. and so that the sheet interval is 179 mm. Part (b) of FIG. 12 is a plot of the pressing roller temperature at timing immediately before a 19-th recording material enters the fixing nip N3 in the case when continuous printing of the image on the 20 sheets in this condition. The temperature distribution of the pressing roller 22 was different from the temperature distribution in part (a) of FIG. 12, and was such that the pressing roller temperature was substantially the same in the entire region.

In this embodiment, the one-side slack of the recording material between the transfer nip and the fixing nip was not observed, and the image rubbing of the image I was not observed. Further, the fixing film 20 was not shifted toward the left side and was rotated with a proper clearance from a member opposing the opposite ends of the fixing film 20 with respect to the longitudinal direction of the heater.

In this printing, the temperature control was carried out by providing a difference of 10° C. among the control temperatures in the sheet interval period, but this temperature difference may preferably be changed depending on the control temperature difference among the respective heat generating blocks during printing (during fixing operation). That is, in the case when the control temperature difference among the heat generating blocks during printing (during fixing operation) is small, also the control temperature difference among the heat generating blocks in the sheet interval provided may preferably be made small. On the other hand, in the case when the control temperature difference among the heat generating blocks during printing (during fixing operation) is large, also the control temperature difference among the heat generating blocks in the sheet interval period may preferably be made large.

Thus, in the image forming apparatus using the division heater 300, the control temperature of the respective heat generating blocks in the period of a sheet interval between a preceding recording material P and its subsequent recording material P depending on the control temperature of the respective heat generating blocks during printing. As a result, it is possible to provide an image forming apparatus with no occurrence of the image rubbing and with no risk of breakage of the fixing film 20.

In the above, preferred embodiments of the present invention were described, but the present invention is not limited thereto and is applicable to image forming apparatuses of various forms (types).

In the above-described embodiments, the full-color image forming apparatus including the intermediary transfer belt as the image bearing member was described as an example, but the present invention is not limited thereto. For example, the present invention is also applicable to a tandem full-color image forming apparatus of a recording material feeding type in which the toner image is directly transferred from the photosensitive drum as the image bearing member onto the recording material or applicable to a monochromatic image forming apparatus. Or, the present invention is also applicable to a full-color image forming apparatus of a 4-path recording type in which recording is carried by four times of scanning in a unit area.

In the above-described embodiments, the constitution in which the fixing film is driven by the pressing roller positioned on a non-print surface side of the recording material was described as an example, but the present invention is not limited thereto. Even in a constitution in which a rotatable member positioned on a print surface side of the recording material is driven, the dew condensation slip phenomenon itself occurs, so that the problems such as the image rubbing and the paper creases arise in some cases, and therefore, the control in the present invention is effective.

Further, as a method of representing the difference in average print ratio between the regions, description was made by acquiring the image unevenness x, but the method is not limited to the methods described in the above-mentioned embodiments when the difference in average print ratio between the regions causing the difference between the left-right feeding forces can be quantitatively discriminated.

As the execution condition of the control, description was made such that the environment in which the image forming apparatus is installed is detected by the temperature and humidity sensor and depending on a result thereof, whether or not the control should be executed is discriminated. For example, the control in the present invention may also be executed in the case when a large water content of the recording material P is detected by a method of measuring the resistance of the recording material P or by the like method.

Further, in the above-described embodiments, as the heating means for heating the fixing nip, the heater contacting the inner peripheral surface of the film was used, but the heating means is not limited thereto. For example, as the heating means for heating the fixing nip, it is also possible to use an exciting coil for causing the film to generate heat by electromagnetic induction heating.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image forming apparatus for forming a toner image on a recording material, the image forming apparatus comprising:

an image forming portion configured to form the toner image on the recording material;

a fixing portion including a heater and configured to fix the toner image on the recording material by heating the toner image formed on the recording material; and a controller configured to control said image forming apparatus, wherein, when toner images are continuously formed on a plurality of recording materials, said controller sets an interval between a preceding recording material and a subsequent recording material depending on unevenness of a print ratio of the subsequent recording material with respect to a direction perpendicular to a recording material feeding direction of the subsequent recording material.

2. The image forming apparatus according to claim 1, wherein said controller sets the interval so that the interval when the unevenness is greater than a threshold is greater than the interval when the unevenness is less than the threshold.

3. The image forming apparatus according to claim 1, wherein said controller sets the interval so as to be greater with a greater unevenness.

4. The image forming apparatus according to claim 1, wherein said fixing portion causes said heater to generate heat in a period, the period being the interval between the preceding recording material and the subsequent recording material.

5. The image forming apparatus according to claim 4, wherein said heater includes a plurality of heat generating blocks that are provided along a direction perpendicular to the recording material feeding direction and that are controlled independently of each other, and wherein said controller sets, depending on image information, a control temperature of said heat generating blocks when the toner image is heated.

6. The image forming apparatus according to claim 5, wherein said controller sets the control temperature of each of said heat generating blocks in the period based on the control temperature of said heat generating blocks when the toner image is heated.

7. The image forming apparatus according to claim 1, wherein said fixing portion includes (i) a cylindrical film rotatable in contact with the recording material and (ii) a pressing roller, said cylindrical film and said pressing roller being configured such that the recording material is sandwiched between said cylindrical film and said pressing roller.

8. The image forming apparatus according to claim 7, wherein said cylindrical film is driven by said pressing roller.

9. The image forming apparatus according to claim 7, wherein said heater contacts an inner surface of said film.

10. The image forming apparatus according to claim 9, wherein said heater and said pressing roller form a fixing nip, in which the recording material is to be nipped and fed, between said cylindrical film and said pressing roller.

* * * * *